United States Patent [19]

Seki et al.

[11] Patent Number: 4,639,605

[45] Date of Patent: Jan. 27, 1987

[54] FIRE SENSOR DEVICE

[75] Inventors: Hiroshi Seki, 2265 Kamihongo, Matsudo-shi, Chiba-ken; Ryuichiro Kataishi, Kyoto, both of Japan

[73] Assignee: Hiroshi Seki, Chiba, Japan

[21] Appl. No.: 601,176

[22] Filed: Apr. 17, 1984

[30] Foreign Application Priority Data

Apr. 20, 1983 [JP] Japan ..... 58-69752

[51] Int. Cl.[4] ..... G08B 17/12

[52] U.S. Cl. ..... 250/554; 340/578

[58] Field of Search ..... 250/554, 227, 372, 342, 250/236, 226; 356/300, 330, 308, 309, 326, 328; 340/815.31, 600, 578, 630

[56] References Cited

FOREIGN PATENT DOCUMENTS 2210354 1/1979 Fed. Rep. of Germany ..... 250/554

*Primary Examiner*—Gene Wan

*Attorney, Agent, or Firm*—Fleit, Jacobson, Cohn & Price

[57] ABSTRACT

A fire sensor device of the type capable of detecting flame and smoke. The fire sensor device has a detector unit having a condenser lens for determining variations in the brightness of a space on the basis of variations in the illumination thereof which occur due to the movement of flames of a fire or the presence of smoke therein. The fire sensor device has two frequency-detection circuits which have different set points and to which the detector unit is connected. The frequency and amplitude of a signal output from the detector unit and the number of pulses generated by the detector unit are computed, and the presence of a fire is detected on the basis of the duration of the signal.

9 Claims, 7 Drawing Figures

FIRE SENSOR DEVICE

BACKGROUND OF THE INVENTION

This invention relates to a fire sensor device for detecting both flames and smoke produced by a fire.

Conventional fire sensor devices which are generally used include a heat sensor, which utilizes the heat generated by a fire, and a smoke sensor which catches smoke. Known heat sensors include, for example, bimetal types of heat sensor, thermal semiconductor types of heat sensor, and thermocouple types of heat sensor. A bimetal type of heat sensor consists of a metal of a low coefficient of expansion and a metal of a higher coefficient of expansion attached to each other. When this bimetal strip which is fixed at one end is heated, it bends toward the metal of the lower coefficient of expansion. This heat sensor uses metals which are displaced in proportion to the temperature applied thereto. Thermal semiconductor and thermocouple heat sensors utilize the Seebeck effect. Smoke sensors include, for example, photoelectric smoke sensors which utilize dimmed or scattered light to detect smoke. A dimmed-light type of smoke sensor utilizes a property such that light is attenuated by smoke, and is actuated when the density of the smoke in a smokedetecting portion of the sensor has reached a predetermined level. FIG. 1 shows a dimmed-light type of fire sensor in which the light radiated from a light source 2 in a light-emitting unit 1 is turned into parallel rays of light 2' by a lens 3, the rays of light 2' reach a lens 6 in a light-receiving unit 5 positioned opposite to the light-emitting unit 1. When smoke flows into the region (optical path) between the lenses 3, 6 through which the parallel rays of light pass, the quantity of light received by a light-receiving element 7 decreases to an extent that is proportional to the flow rate of the smoke. When the quantity of light received by the element 7 reaches a predetermined level, an output 8 is obtained, i.e. the sensor starts to operate. Reference numeral 4 denotes a light-receiving element in the light-emitting unit 1. This element 4 is used to compensate for changes in brightness, e.g. when the luminance of the light source drops.

The use of these two types of devices, a heat sensor and a smoke sensor, is permitted under the Fire Services Act. However, all the various kinds and magnitudes of fires cannot be dealt with in practice with these two sensors along. In order to discover a fire early, the detection of flames is necessary in some cases. A known flame sensor includes an infrared sensor and an ultraviolet sensor. The infrared sensor picks up the electromagnetic radiation emitted by the flames of a fire, and is capable of detecting the distinctive radiation of a wavelength in the vicinity of 4.3 μm of the high-temperature $CO_2$ gas generated when a combustible material, such as town gas, gasoline or wood, burns. However, an infrared sensor is expensive and is likely to be affected by sunlight and electric light, it is also not able to detect smoke.

SUMMARY OF THE INVENTION

An object of the present invention is to provide an inexpensive fire sensor device which can detect not only flame but also smoke.

Another object of the present invention is to provide an improved fire sensor device which is not affected by sunlight and electric light.

A further object of the present invention is to provide an inexpensive flame and smoke detector type of fire sensor device which is able to detect a fire early.

The present invention provides a fire sensor device comprising a detector unit consisting of a condenser lens which can determine variations in the brightness only of a space, a photoelectric conversion element, and a preamplifier; and two frequency-detecting circuits which have different set points and which each consist of a frequency comparator circuit, a pulse number detection circuit and an AND circuit. The detector unit is connected to the frequency-detecting circuits through corrector circuits, such as an AGC amplifier, a primary delay circuit and a DC amplifier. The frequency and amplitude of a signal output and the number of pulses generated during a predetermined period of time by the detector unit are computed, and flames and smoke are detected with a high accuracy on the basis of the duration of the signal.

DETAILED DESCRIPTION OF THE INVENTION

Figure 1:
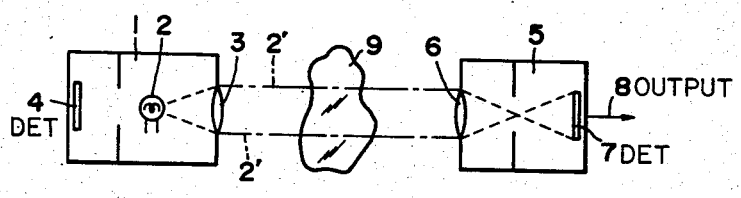
FIG. 1 (PRIOR ART)
FIG. 1 illustrates a conventional dimmed-light type of sensor.

The present invention will now be described with reference to an embodiment thereof shown in the drawings.

Figure 3:
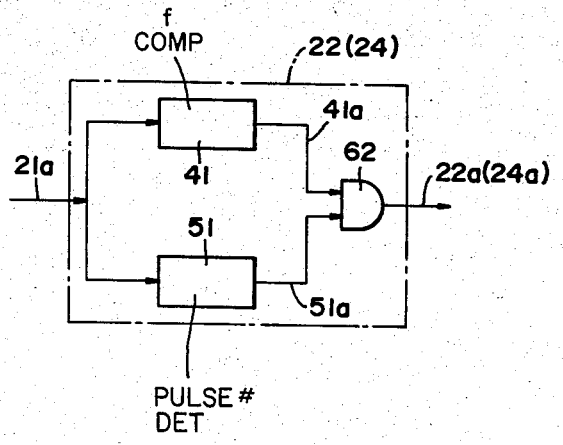
FIG. 3 is a block diagram of a frequency-detecting circuit of the embodiment.
Figure 2:
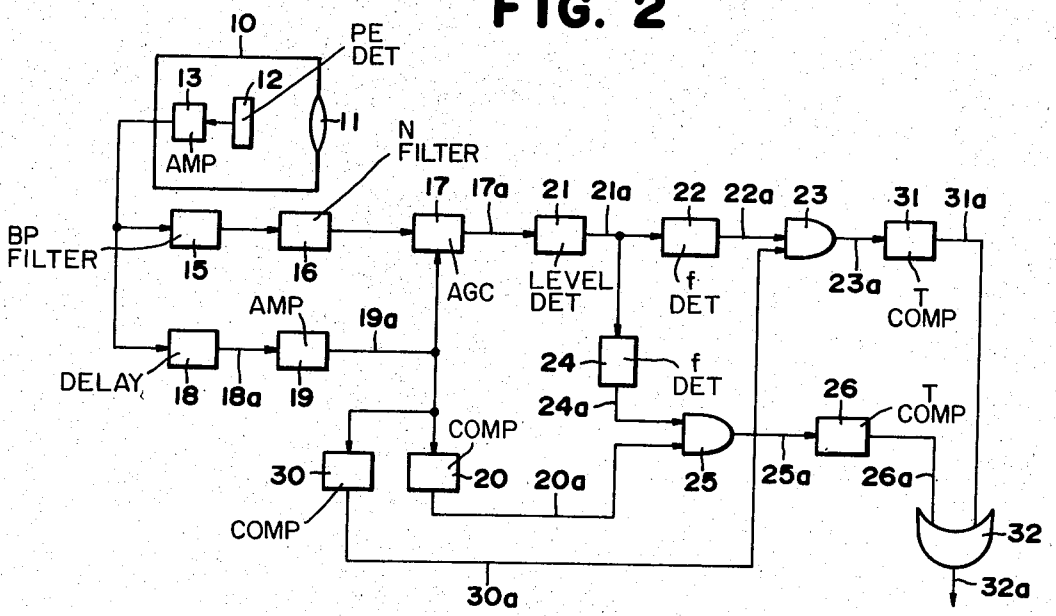
FIG. 2 is a block diagram of an embodiment of the present invention.
Figure 4A:
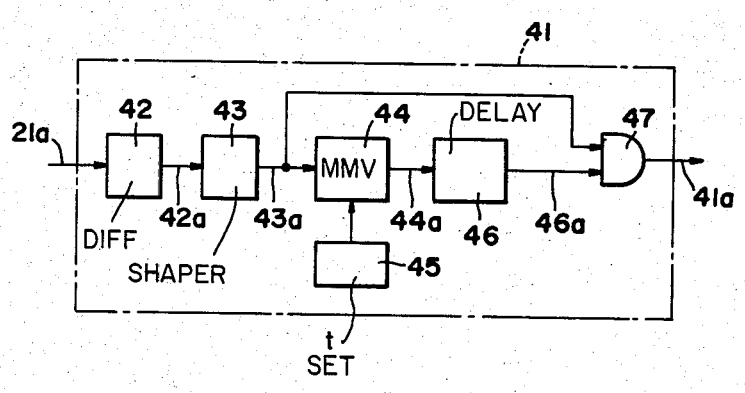
FIG. 4A is a block diagram of a frequency comparator circuit of the embodiment.

Referring to FIG. 2, a detector unit 10 consists of a combination of a condenser lens 11, a photoelectric conversion element 12 (PE DET 12) separated by a predetermined distance from the condenser lens 11, and a preamplifier 13. A band-pass filter 15 of, for example, 3–40 Hz, and a notch filter 16 are connected to an output portion of the detector unit 10. A primary delay circuit 18 and a DC amplifier 19 which together constitute a linearizer are also connected to the output portion of the detector unit 10, parallel to the filters 15, 16. An AGC amplifier 17 is connected to the notch filter 16. The notch filter 16 employed in the invention is adapted to cut out the commercial frequency f and the frequency 2f. The purpose of cutting out the frequency f is to eliminate the induction noise of the AC power source, and the purpose of cutting out the frequency 2f is to eliminate noise due to AC illumination, and thereby stabilize the operation of the device. Reference numeral 20 denotes an illumination comparator which generates an output **20*a* when the amplitude of a signal constituting an output 19*a* has dropped below a predetermined level, reference numeral 21 is a wind comparator connected to the AGC amplifier 17 to act as an amplitude level detector, and reference numerals 22, 24 are two frequency-detecting circuits connected to a node of the wind comparator 21 which have different set points, and are each provided with a frequency comparator circuit 41 (see FIG. 3), a pulse number detection circuit 51 and an AND circuit 62, as shown in FIG. 3. Each frequency comparator circuit 41 determines whether an input frequency is higher than the corresponding set point or not. An example of details of the construction of the circuit 41 is shown in FIG. 4A. The circuit 41 consists mainly of a differentiating circuit 42, a waveformshaping circuit 43, a monostable multivibrator 44, a delay circuit 46, and AND circuit 47, and a time-setting circuit 45 connected to the monostable multivibrator 44**.

Figure 4B:
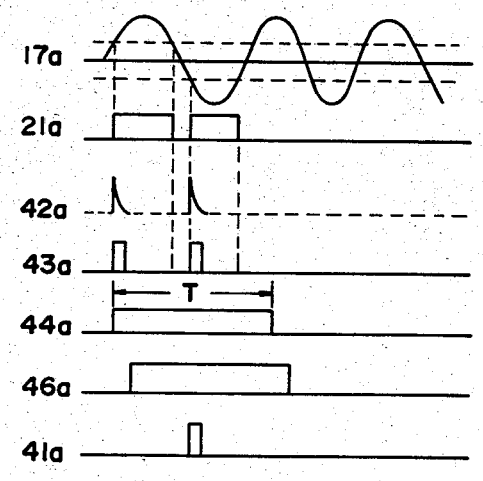
FIG. 4B illustrates the waveforms of outputs from the frequency comparator circuit.
Figure 5A:
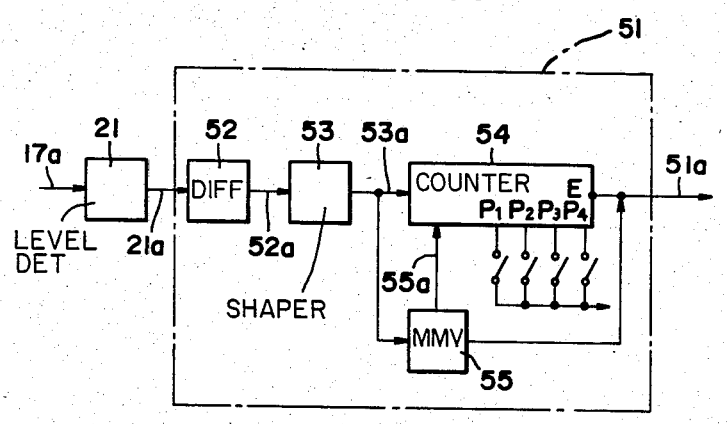
FIG. 5A is a block diagram of a pulse number detection circuit.

FIG. 4B shows the waveforms of outputs 17*a*, 21*a*, 42*a*, 43*a*, 44*a*, 46*a*, 41*a*. When the relationship $(\frac{1}{2}f) < T$ holds approximately between the input frequency f of the wind comparator 21 and the width T of an output pulse from the monostable multivibrator 44, an output of a waveform 41*a* is generated by the frequency comparator circuit 41. The width T can be regulated as required by the time-setting circuit 45. The pulse number detection circuit 51 is constructed as shown in FIG. 5A, it consists of a differentiating circuit 52, a waveform-shaping circuit 53, a presetting counter 54, and a monostable multivibrator 55. The presetting counter 54 is provided with presetting input terminals P1–P4, and can be set for a predetermined number of pulses. The purpose of providing this pulse number detection circuit 51 is to allow for variation times in the distribution of brightness for the operation of the device. Namely, this circuit 51 is employed to eliminate the influence of sunlight, electric light, and noise.

Figure 5B:
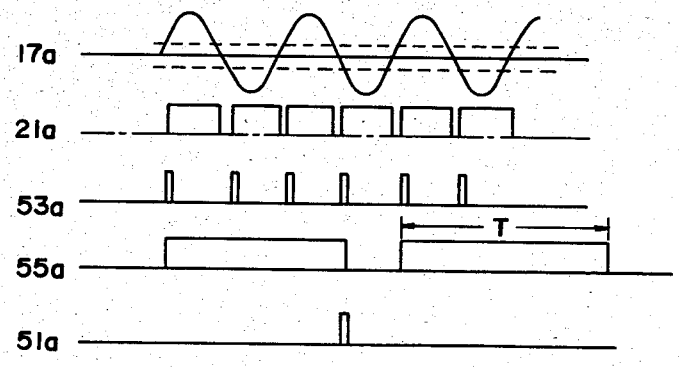
FIG. 5B illustrates the waveforms of outputs from the pulse number detection circuit.

FIG. 5B shows the waveforms of outputs 17*a*, 21*a*, 53*a*, 55*a*, 51*a*. When pulses are input through the wind comparator (level detector) 21, the presetting counter 54 is decremented for each input pulse. When the content of the counter 54 becomes zero, a signal of a waveform 51*a*, as shown in FIG. 5B, is output to a carry-out terminal E. If the content of the presetting counter 54 does not become zero within the set time T of the monostable multivibrator 55, no output signal is generated at the re-preset terminal E. The waveforms shown in FIG. 5B are the waveforms of outputs generated when the presetting input switch is set so that four clock pulses are output.

Provision of the frequency comparator circuit 41 and the pulse number detection circuit 51 (both included in frequency detectors 22 and 24) makes it possible to detect flames and smoke with a high accuracy.

The frequency-detecting circuit 22 provided with the frequency comparator circuit 41 and pulse number detection circuit 51 is set to a level higher than that to which the frequency-detecting circuit 24, which is provided with circuits identical to the circuits 41 and 51, is set. Reference numeral 31 denotes a time comparator which is provided with a monostable multivibrator and an integrator. If the time comparator 31 is set to, for example, 5 seconds, an output 31*a* is generated when a signal is input thereto for 5 consecutive seconds. Reference numeral 23 denotes an AND circuit which generates an output 23*a* only when it receives at the same time inputs based on outputs 22*a*, 30*a*. The output 30*a* is generated by an illumination comparator 30 when the amplitude of a signal from the DC amplifier 19 has exceeded a predetermined level. Flames are detected by the frequency-detecting circuit 22, AND circuit 23 and comparator 31. Reference numeral 25 denotes an AND circuit which generates an output 25*a* when it receives at the same time inputs based on outputs 24*a*, 20*a*. When a time comparator 26 which is provided with a monostable multivibrator and a integrator receives the input 25*a* continuously for at least a predetermined period of time, an output 26*a* is generated therein. The frequency-detecting circuit 24, AND circuit 25 and time comparator 26 form a smoke-detecting circuit.

Accordingly, flames can be detected by the output 31*a*, and smoke by the output 26*a*. When an OR circuit 32 receives the outputs 31*a*, 26*a*, an output 32*a* is generated therein simultaneously with the occurrence of flames or smoke, so that the generation of the output 32 means that a fire has been sensed. When black smoke is produced from the carbon particles released when plastics or combustible liquids burn, an illumination voltage in the detector unit 10 drops. When the white smoke of a smoldering fire is generated, the brightness of the smoke increases because of scattered light. The invention enables the detection of both of these types of smoke.

In this sensor device, the AGC amplifier 17, the primary delay circuit 18, and the DC amplifier 19 form corrector circuits which correct any errors due to the brightness of the environment and the clouding of the lens to achieve a correction of slow variations in the illumination. Even when light is applied suddenly to the condenser lens 11 by, for example, a light projector, the output 22*a*, which is a frequency output, lasts for only a short period of time (not more than 0.1 second) since the input of a signal to the condenser lens 11 is a necessary step in the indicational response of the system, owing to the operations of the pulse number detection circuit and time comparator employed in this sensor device, although its amplitude level will become high. In such a case, the output 31*a* is not generated. When flames occur, a frequency component (within 10–40 Hz) due to variations in the brightness distribution is present continuously.

As stated above, the fire sensor device according to the present invention is provided with a detector unit with a condenser lens which determines variations in the brightness of a space, a photoelectric conversion element, two frequency-detecting circuits with different set points, AND circuits, and a time comparator. Accordingly, it acts as a highly-reliable fire sensor device which enables the early detection of both flames and smoke in a simple and reliable manner. The sensor device is not, of course, actuated by sudden variations in the illumination due to light from a light projector, etc.

Although the present invention has been described with reference to the preferred embodiment thereof, many alterations and modifications can be made within the spirit of the invention.

We claim:

1. A fire sensor device for detecting the movement of flames and the presence of smoke comprising:

(1) a detector unit having a condenser lens adapted to determine variations of brightness based upon variations in the illumination of said detector unit which occur due to said movement of flames of a fire and said presence of smoke proximate said detector unit and for producing a detector signal, (2) correction circuit means, connected to said detector unit, for compensating errors in said detector signal due to slowly changing variations in the illumination of said detector unit, (3) a first frequency detection circuit, connected to said correction circuit means and receiving the compensated detector signal, for detecting flame, (4) a second frequency detection circuit, connected to said correction circuit means and receiving the compensated detector signal, for detecting smoke, wherein the frequency and amplitude of said detector signal output from said detector unit and the number of pulses generated, based upon said detector signal, during a predetermined period of time are computed, thereby detecting the presence of fire on the basis of the duration of the computed signal.

2. The fire sensor device according to claim 1, wherein each of the first and second frequency detector circuit has a frequency comparator circuit, a pulse number detection circuit and an AND circuit.

3. The fire sensor device according to claim 2, wherein said pulse number detection circuit of the first frequency detection circuit is set to a level higher than that of said second frequency detection circuit.

4. The fire sensor device according to claim 1, wherein said detector unit comprises further a photoelectric conversion element spaced from said condensor lens, and a preamplifier connected to said photoelectric conversion element.

5. The fire sensor device according to claim 1, wherein a band-pass filter and a notch filter are connected to an output portion of said detector unit, and a primary delay circuit and a DC amplifier are connected to said output portion of the detector unit in parallel to said band-pass filter and said notch filter, and wherein an AGC amplifier is connected to said notch filter.

6. A fire sensor device according to claim 1, wherein said correction circuit means has an AGC amplifier, a primary delay circuit and a DC amplifier.

7. The fire sensor device according to claim 1 wherein said errors due to slowly changing variations in the illumination are in contrast to rapid variations in the illumination due to the frequency component of illumination by said flames and the relatively faster variations in the illumination due to said presence of smoke.

8. A fire sensor device for detecting the movement of flames and the presence of smoke comprising a detector unit having a condenser lens adapted to determine variations of brightness based upon variations in the illumination of said detector unit which occur due to said movement of flames of said fire and said presence of smoke proximate said detector unit, a photoelectric conversion element and a preamplifier as part of said detector unit; and two frequency-detecting circuits which have different set points and to which said detector unit is connected through a corrector circuit compensating for slowly changing variations of a signal output from said detector unit, so that the frequency and amplitude of said signal output from said detector unit and the number of pulses generated, based upon said signal, during a predetermined period of time are computed, and the presence of a fire is detected on the basis of the duration of said signal.

9. The fire sensor device according to claim 8 wherein said frequency-detecting circuits include means for determining the frequency and amplitude of said signal, means for generating and counting pulses based upon said signal, and means for producing a further signal when said pulses concurrently exceed a predetermined number and said frequency and amplitude of said signal concurrently exceed predetermined frequency and amplitude values.

* * * * *